United States Patent [19]

Lombardo

[11] 4,001,803

[45] Jan. 4, 1977

[54] LIGHTING DEVICES

[76] Inventor: Dominick A. Lombardo, 5 Cottage St., Norwalk, Conn. 06856

[22] Filed: Oct. 1, 1975

[21] Appl. No.: 618,380

[52] U.S. Cl. ..... 340/248 B; 240/37.1; 339/34; 340/253 C

[51] Int. Cl.[2] ..... G08B 21/00

[58] Field of Search ..... 340/248 B, 253 C; 339/34 X, 14 P; 240/37.1

[56] References Cited

UNITED STATES PATENTS

| | | | |
|---|---|---|---|
| 2,863,038 | 12/1958 | Lombardo | 240/37.1 |
| 3,458,794 | 7/1969 | Bohnstedt et al. | 339/34 X |
| 3,801,974 | 4/1974 | Aitken | 340/248 B |

*Primary Examiner*—John W. Caldwell
*Assistant Examiner*—Daniel Myer
*Attorney, Agent, or Firm*—William G. Rhines

[57] ABSTRACT

An emergency power failure indicator circuit and night light adapted for use as a portable flashlight having wall outlet insertion prongs which are extendable from the body of the unit with concurrent actuation of a brush-type switch paralleling an on-off switch in the circuitry of the emergency light in the indicator circuit, thereby rendering the unit more suitable to be carried about as a flashlight as well as ensuring operability of the emergency light under power failure conditions.

24 Claims, 4 Drawing Figures

LIGHTING DEVICES

BACKGROUND OF INVENTION

In my U.S. Pat. No. 2,863,038, I disclosed an auxiliary electrical wall outlet unit useful as a night light, but also having associated emergency elements by which, in the event of a power failure, emergency lighting is provided by deactuation of a relay which permits closure of a normally closed switch which causes energization of an auxiliary battery operated emergency light.

While such devices have been found to be very effective and useful, it has been found desirable to accomodate certain other needs as well in the use of such devices. For example, a person traveling who desires to use such devices in a hotel may find it awkward or inconvenient to transport such devices in a pocketbook or suitcase because of the male connector prongs projecting therefrom. Furthermore, in such an instance, the prongs are susceptible to being bent, broken, or otherwise damaged. Additionally, it has been found useful to have a unit which is at once useful as a flashlight as well as for the aforesaid nightlight and emergency light purposes.

Accordingly, it is an object of the present invention to provide a wall pluggable combination nightlight and emergency light with retractable plug prong means.

Another object of this invention is to provide a wall plugable combination nightlight and emergency light which may also be used as a portable flashlight.

Yet another object of this invention is to provide a wall pluggable combination nightlight and emergency unit, whether or not also adapted for use as a flashlight, with means to ensure against inadvertant interruption of the emergency light energization circuit when said unit is inserted into a wall plug outlet.

SUMMARY OF THE INVENTION

Desired objectives may be achieved through practice of the present invention which, in one embodiment, comprises a housing containing a nightlight circuit electrically interconnected with wall outlet plug prongs that may be selectively withdrawn to within the housing, and a second combination flashlight-emergency light circuit electrically interconnected with an internally housed battery power source.

The second circuit includes a normally closed, relay operated on-off switch in which the relay is actuated and the switch is therefore opened upon the nightlight circuit being energized. This switch is positioned between the battery and a parallel circuit, one leg of which includes a manually operated on-off switch and the other of which includes an on-off switch which is closed by and upon said prongs being extended outward from said housing.

DESCRIPTION OF DRAWINGS

This invention may be understood from the description which follows and from the attached drawings in which.

DESCRIPTION OF PREFERRED EMBODIMENT

Figure 1:
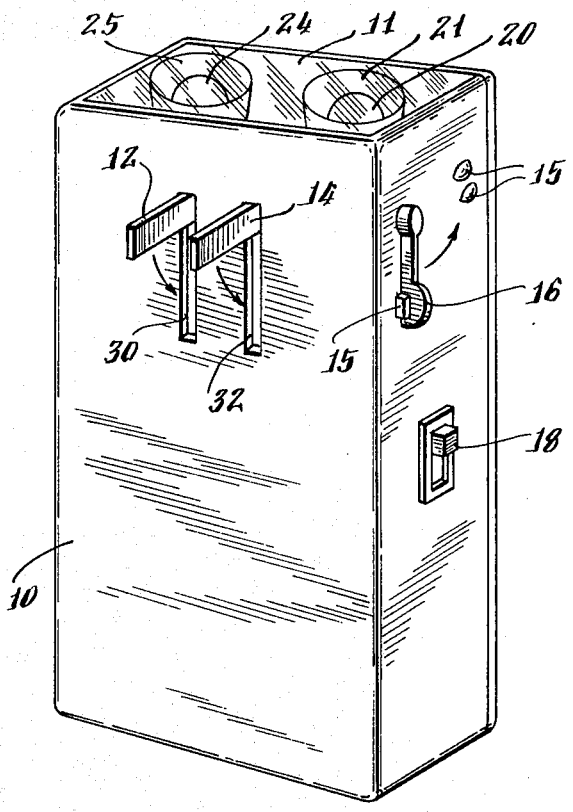
FIG. 1 is a perspective drawing of one embodiment of the present invention.

FIG. 1 is a perspective view of an embodiment of the present invention. It includes a hollow rectangular housing 10, to one end of which is affixed a transparent panel 11 through which nightlight bulb 24, with which a reflector 25 is associated, and flashlight-emergency light bulb 20, with which a reflector 21 is associated, may shine. Affixed in the wall of the housing 10 is a manual switch 18 for actuation of the bulb 20 when the device is to be used as a flashlight. A wall of the unit includes prong slots 30, 32 through which wall outlet plug prongs 12, 14 respectively may be caused to project as hereinafter described. Positioned at a wall of the housing 10 is a lever arm affixed to a shaft 42 which extends through the wall and to which the bases of the prongs 12, 14 are affixed. Preferably the shaft 42 is made from some electrically non-conductive material as an effective means to ensure that the prongs 12, 14 are isolated electrically from each other and from the lever arm 16.

Figure 2:
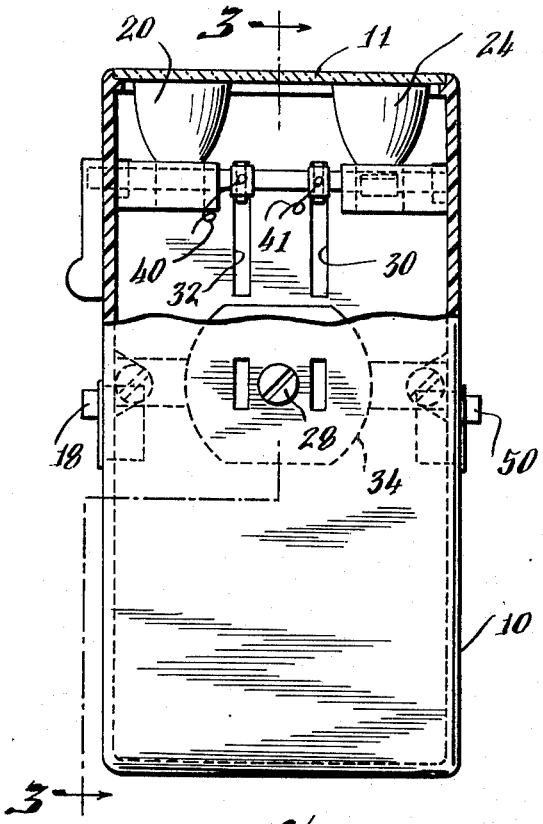
FIG. 2 is a partial cross-section of the embodiment of the present invention shown in FIG. 1.

The interrelationship of these components will be clear from FIG. 2, in part cross-section taken parallel to the shaft 42, which shows in addition a manual switch 50 to close the circuit energizing the nightlight bulb 24, a female prong receptacle 34 affixed to the housing 10 by means of a screw 28 to provide a means for other appliances to be energized without loss of plug space because of the unit having been plugged into a wall socket, and conductive pigtails 40, 41 connected respectively to the prongs 14, 12 as a means to permit the passage of electricity from them to the associated circuitry while also enabling the prongs 12, 14 to be swung into and out of a projecting position through the slots 30, 32 by movement of the lever arm 16 with consequent rotation of the shaft 42.

Figure 3:
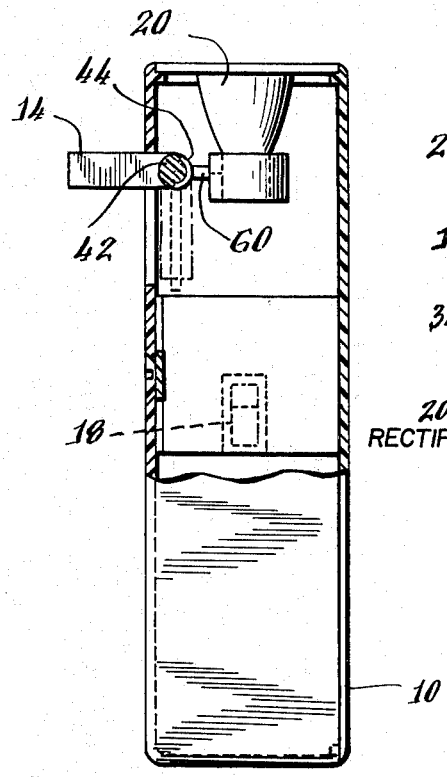
FIG. 3 is a partial cross-section of the embodiment of the present invention shown taken through line 3—3 of FIG. 2.

FIG. 3, which includes a cross-section along line 3—3 shown in FIG. 2, illustrates a switch useful in embodiments of the present invention, including a brush 44 affixed to a portion of the peripheral surface of the shaft 42, to effect electrical interconnection between the brush contacts 60, 61 (see FIG. 4), when the shaft 42 is so rotated that the prongs 12, 14 are in the extended position illustrated in FIG. 1. The effect of this switch having closed is to close a circuit which parallels that of the flashlight switch 18.

Figure 4:
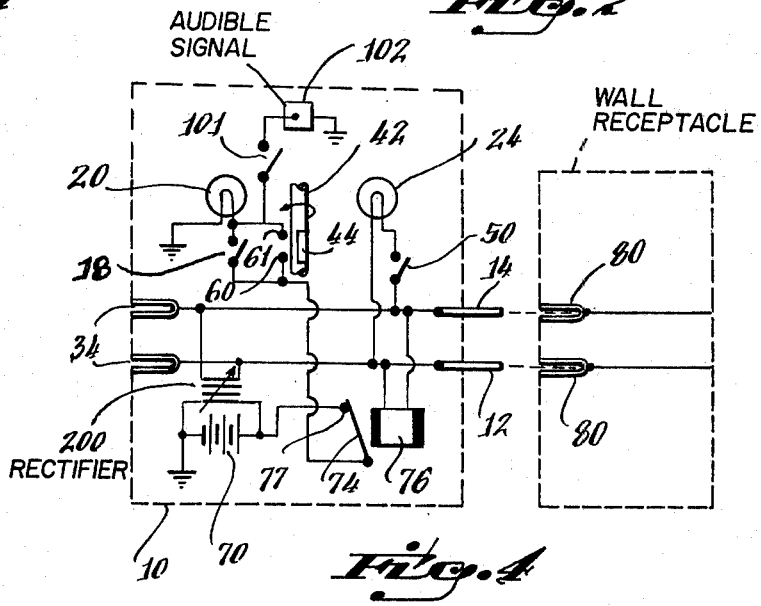
FIG. 4 is a diagram of a circuit useful in the operation of the embodiment of this invention shown in FIGS. 1–3.

FIG. 4 describes circuitry useful in practicing the embodiment of the present invention discussed above. It includes, in addition to elements identified above, relay coil 76, normally closed contact 77, relay contact 74, and battery 70. Also shown is an associated wall receptacle 80 into which the prongs 12, 14 may be inserted.

Additionally, from FIG. 4 the various operational features of this embodiment of this invention will be apparent. For example, as illustrated, the device may be used as a flashlight merely by closing the switch 18, which will complete the circuit from the battery, through the (normally) closed relay armature 74, to the bulb 20. However, when the unit is to be used as an emergency and night light, the wall socket prongs 12, 14 are moved into the extended position shown to prepare them for insertion into the wall receptacle 80 by movement of the lever arm 16 with consequent rotation of the shaft 42, which causes the brush 44 to effect electrical interconnection between the brush contacts 60, 61, thereby perfecting a conductive circuit which is parallel to that of the switch 18. By this means, it is assured that the bulb 20 and its associated circuitry will be set up to perform an emergency function as herein described even though the user may have inadvertently forgotten to close the switch 18. Stops 15 hold the arm in place.

Upon the prongs 12, 14 being inserted into the wall receptacle 80, the relay coil 76 will cause the relay armature 74 to move from its normally closed position of touching the contact 77, thereby interrupting the continuity of the circuit between the battery 70 and the bulb 20. It should also be noted that this provides a last minute check of the operability of the emergency light circuit and bulb 20 in the event of a power outage. Thereafter, the night light 24 may be actuated by closure of the switch 50. If, subsequently, there is a power failure, the relay coil 76 will be de-energized, permitting the relay armature 74 to return to its normally closed position in contact with relay contact 77, thereby completing the circuit between the battery 70 and the bulb 20, causing the latter to become lighted. Thus, the user will have a light source already lit to permit him to move about in the dark if desired, and to continue to have a night light which will automatically go off of battery powered operation when the power goes back on. On the other hand, if the user wishes to remove the unit from the wall socket and use it as a portable flashlight, he can do so, and can close the switch 18 to ensure that the bulb 20 will stay lit with the battery 70 as a power source, even though the prongs 12, 14 are retracted through actuation of the lever arm 16 with consequent rotation of the shaft 42, bringing the brush 44 out of contact with the brush contacts 60, 61. Subsequently, the bulb 20 may be completely extinguished by opening the switch 18, leaving no path of electrical continuity between the battery 70 and the flashlight 20.

It is to be understood that the embodiments of the present invention herein described and illustrated are by way of illustration and not of limitation and that those skilled in the arts may practice this invention in a wide variety of embodiments without departing from the spirit or scope of this invention. For example, as is shown in FIG. 4, the battery power source may be a nickel-cadmium or other re-chargeable energy source which may be re-charged while the night light is plugged into a wall socket power source through the use of a rectifier 200 and associated charging circuit of known design and function which may include a regulator (not shown) to stop the charging process when the battery is fully charged. Such re-charging facilities may also be provided by an auxiliary charging unit, for example of the type used to re-charge hand calculator batteries from a wall socket. Optionally, other auxiliary features, such as the buzzer circuit illustrated in FIG. 4 may also be accomodated. As shown, such a circuit can include a manual on-off switch 101 connected to a buzzer 102 on the lamp side of the switches 18 and the switch contact 61. Thereby, when the emergency light circuit becomes energized, if the switch 101 has been closed, the buzzer 102 will sound, awakening or otherwise alerting the user to the fact that the power has gone off. Such a feature might be particularly advantageous in certain circumstances, for example where a life-support mechanism, such as an iron lung, is involved.

Other embodiments might include a thermally responsive means, such as a bi-metal switch, instead of the relay and associated switch described above, to effect connection of the emergency circuit upon interruption of the main power circuit, connector means other than male wall receptacle prongs, such as coaxial tubular connectors, and a connector extender-emergency circuit switch mechanism which operates by linear motion rather than by the circular motion herein described. It is also to be understood that embodiments of this invention may be made without the flashlight feature herein described by eliminating the portion of the parallel circuit which includes the switch 18, and/or without the auxiliary "pass-through" female connector 34 if desired. Such exemplary changes, as well as others which will be apparent to those skilled in the cognizant arts, are within the contemplation of the present invention.

I claim:

1. A lighting unit comprising a protective housing in which are positioned a main circuit terminating in a pair of connector prongs for insertion into corresponding conductive receptacles of an electrical power source, said prongs being selectively extendable from said unit parallel to each other by having one of their respective ends swung outward therefrom, a first lighting circuit which is electrically connected to said main circuit and to a first lamp and includes a manually operable on-off switch positioned between said lamp and said main circuit, a second lighting circuit which is isolated electrically from said main circuit and said first circuit and electrically interconnects a battery with a second lamp through a normally closed switch and through two switches which are in series with said normally closed switch and are in parallel with each other, one of which parallel switches is a manually operable on-off switch and the other of which switches is an on-off switch which is mechanically integrated with said prongs and closes simultaneously with said prongs being swung outward from said unit, and a relay which is connected to said main circuit and causes said normally closed switch to open in response to energization of said main circuit.

2. The device described in claim 1 wherein said battery is rechargeable, and including means electrically connected to said main circuit for re-charging said battery.

3. The device described in claim 2 including auditory signal means electrically connected in series with a manual on-off switch to said second circuit at a point between said second lamp and said other switch.

4. The device described in claim 1 including auditory signal means electrically connected in series with a manual on-off switch to said second circuit at a point between said second lamp and said other switch.

5. A lighting unit comprising a main circuit terminating in connector means for removeably electrically interconnecting said circuit to an electrical power source, said means being selectively extendable outward from said unit, a first circuit which is electrically connected to said main circuit and to a first electricity responsive indicator means and includes a manually operable switch means for selectively interrupting the continuity of the circuit therebetween, a second circuit which is independent electrically from said main circuit and said first circuit, for effecting electrical interconnection between an electrical power source other than said main circuit and a second electrically responsive indicator means through a normally closed switch and through switch means connected between said normally closed switch and said second indicator means, which switch means comprises an on-off connector switch which moves into the closed position simultaneously with said connector means being extended outward from said unit, and interrupter means for causing said normally closed switch to open in response to electrical energization of said main circuit.

6. The device described in claim 5 wherein said interrupter means is a relay.

7. The device described in claim 6 wherein said switch means includes an on-off switch electrically connected in parallel with said connector switch.

8. The device described in claim 3 wherein said first and said second electricity responsive indicator means are lamps.

9. The device described in claim 8 wherein said switch means includes an on-off switch electrically connected in parallel with said connector switch.

10. The device described in claim 8 wherein said power source connected to said second circuit is a battery.

11. The device described in claim 10 wherein said switch means includes an on-off switch electrically connected in parallel with said connector switch.

12. The device described in claim 10 wherein said connector means is a pair of male wall receptacle prongs which are concurrently extendable from said unit.

13. The device described in claim 12 wherein said switch means includes an on-off switch electrically connected in parallel with said connector switch.

14. The device described in claim 12 wherein said connector switch is integral with a moveable member on which is mounted those ends of said prongs which face toward the interior of said device when said prongs are extended.

15. The device described in claim 14 wherein said switch means includes an on-off switch electrically connected in parallel with said connector switch.

16. The device described in claim 14 wherein said moveable member is a rotatable shaft, and wherein extension of said prongs and simultaneous movement of said connector switch into the closed position is effected by rotation of said shaft.

17. The device described in claim 16 wherein said switch means includes an on-off switch electrically connected in parallel with said connector switch.

18. The device described in claim 17 wherein said battery is rechargeable, and including means electrically connected to said main circuit for re-charging said battery.

19. The device described in claim 18 including auditory signal means electrically connected in series with a manual on-off switch to said second circuit at a point between said second indicator and said switch means.

20. The device described in claim 17 including auditory signal means electrically connected in series with a manual on-off switch to said second circuit at a point between said second indicator and said switch means.

21. The device described in claim 5 wherein said switch means includes an on-off switch electrically connected in parallel with said connector switch.

22. The device described in claim 21 wherein said battery is rechargeable, and including means electrically connected to said main circuit for re-charging said battery.

23. The device described in claim 22 including auditory signal means electrically connected in series with a manual on-off switch to said second circuit at a point between said second indicator and said switch means.

24. The device described in claim 5 including auditory signal means electrically connected in series with a manual on-off switch to said second circuit at a point between said second indicator and said switch means.

* * * * *

UNITED STATES PATENT AND TRADEMARK OFFICE

CERTIFICATE OF CORRECTION

PATENT NO. : 4,001,803

DATED : January 4, 1977

INVENTOR(S) : Dominick A. Lombardo

It is certified that error appears in the above-identified patent and that said Letters Patent are hereby corrected as shown below:

In claim "8", first line, change "3" to "6".

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*